US010828222B2

(12) United States Patent
Jackson

(10) Patent No.: US 10,828,222 B2
(45) Date of Patent: Nov. 10, 2020

(54) GIRD COMPRESSION HIP TENSIONING GARMENT

(71) Applicant: James Earl Jackson, Bronx, NY (US)

(72) Inventor: James Earl Jackson, Bronx, NY (US)

(73) Assignee: James Earl Jackson, Bronx, NY (US)

( * ) Notice: Subject to any disclaimer, the term of this patent is extended or adjusted under 35 U.S.C. 154(b) by 217 days.

(21) Appl. No.: 15/648,518

(22) Filed: Jul. 13, 2017

(65) Prior Publication Data

US 2019/0015283 A1 Jan. 17, 2019

(51) Int. Cl.
*A61H 1/00* (2006.01)
*A41C 1/00* (2006.01)

(52) U.S. Cl.
CPC ..... *A61H 1/008* (2013.01); *A41C 1/003* (2013.01); *A61H 2201/169* (2013.01); *A61H 2205/088* (2013.01)

(58) Field of Classification Search
CPC ..... A61H 1/00; A61H 1/003; A61H 1/006; A61H 1/008; A41B 9/001; A41B 9/02; A41B 9/04
USPC ..... 2/400
See application file for complete search history.

(56) References Cited

U.S. PATENT DOCUMENTS

RE21,624 E * 11/1940 Dann ..... A41B 9/002 2/406
2,567,277 A * 9/1951 Farquhar ..... A41F 11/02 2/312
2,879,771 A * 3/1959 Bell ..... A41C 1/003 450/100
3,035,586 A * 5/1962 Bell ..... A41C 1/003 450/100
3,091,238 A * 5/1963 Bogory, Sr. ..... A61F 5/24 128/100.1
3,174,482 A * 3/1965 Parrott ..... A41B 9/02 2/404
3,524,449 A * 8/1970 Peters ..... A41C 1/00 128/96.1
3,752,164 A * 8/1973 Salisky ..... A41C 1/02 450/123
4,074,364 A * 2/1978 Lucero ..... A41F 17/00 2/117
4,501,026 A * 2/1985 Seneca ..... A41F 9/002 2/308

(Continued)

OTHER PUBLICATIONS

Braceability Sports Hernia Treatment Compression Shorts with Groin Wrap. Printed Oct. 5, 2017. https://www.braceability.com/sports-hernia-groin-shorts.

(Continued)

*Primary Examiner* — Anne M Kozak
(74) *Attorney, Agent, or Firm* — Edward L. Tulin

(57) ABSTRACT

A gird compression hip tensioning garment designed to provide compressive support extending throughout the acetabulofemoral and mid-gluteal portions of a wearer's lower torso so as to help relieve pain and to help promote healing from muscular/skeletal ailments and injuries of the mid-body of a wearer. This gird compression garment is constructed of a resiliently flexible and stretchable material and includes a ligature panel extending from approximately the sacrum of the spine of the wearer to the base of the gluteus medius, and a fastening device adapted to vary the amount of compressive force exerted by the garment.

7 Claims, 4 Drawing Sheets

(56) References Cited

U.S. PATENT DOCUMENTS 4,709,692 A * 12/1987 Kirschenberg ..... A61F 5/028 2/44
4,932,079 A * 6/1990 Bridgewater ..... A41F 17/00 128/101.1
5,177,813 A * 1/1993 Bosack ..... A41F 3/02 2/323
5,193,225 A * 3/1993 Karami ..... A61F 13/64 2/220
5,201,074 A * 4/1993 Dicker ..... A41D 13/0015 2/227
5,814,001 A * 9/1998 Schwenn ..... A61F 5/0193 602/23
5,857,947 A * 1/1999 Dicker ..... A63B 21/00185 2/69.5
5,974,592 A * 11/1999 Tabrizi ..... A41B 9/02 2/400
6,076,193 A * 6/2000 Hood ..... A41D 1/06 2/227
6,231,488 B1 * 5/2001 Dicker ..... A41D 13/0015 2/69
6,430,752 B1 8/2002 Bay
6,440,094 B1 * 8/2002 Maas ..... A61F 5/3738 2/44
6,684,410 B2 * 2/2004 Robinett ..... A41D 1/08 2/228
7,087,032 B1 * 8/2006 Ikeda ..... A61F 5/03 128/891
7,260,961 B1 * 8/2007 Kennedy ..... D04B 1/243 66/171
7,389,547 B1 * 6/2008 Wiens ..... A41D 1/08 2/227
7,509,822 B2 * 3/2009 Ishida ..... A41C 1/003 2/401
8,435,202 B2 * 5/2013 Lartonoix ..... A61F 5/0193 602/60
8,533,864 B1 * 9/2013 Kostrzewski ..... A41D 13/0015 2/69
8,707,463 B2 * 4/2014 Orloff ..... A41D 13/0015 2/22
8,784,351 B2 7/2014 Dumpson et al.
8,910,317 B2 * 12/2014 Decker ..... A41D 13/0002 2/227
9,144,252 B1 * 9/2015 Kostrzewski ..... A41D 1/08
9,895,569 B2 * 2/2018 Yao ..... A63B 69/0028
10,085,503 B2 * 10/2018 Peral ..... A41B 9/02
2002/0007507 A1 * 1/2002 Duran ..... A41B 11/003 2/406
2004/0016043 A1 * 1/2004 Uno ..... A41B 9/001 2/400
2004/0111781 A1 * 6/2004 Miyake ..... A41C 1/003 2/69
2004/0116260 A1 * 6/2004 Drennan ..... A61F 5/0193 482/124
2005/0268379 A1 * 12/2005 MacGeorge ..... A41B 9/02 2/400
2009/0113596 A1 5/2009 Young
2011/0000005 A1 * 1/2011 Brown ..... A61F 5/0111 2/227
2011/0041226 A1 2/2011 Arensdorf
2012/0029407 A1 2/2012 Sawle et al.
2013/0019371 A1 1/2013 Abeysekera et al.
2014/0200121 A1 * 7/2014 von Hoffmann ..... A63B 21/02 482/124
2014/0207041 A1 * 7/2014 Ingimundarson ..... A61F 5/0193 602/23
2014/0310854 A1 10/2014 Kianmahd
2014/0378880 A1 * 12/2014 Arsenault ..... A61F 7/00 602/14
2015/0230531 A1 * 8/2015 Merchen ..... A41F 17/00 2/400
2016/0088885 A1 * 3/2016 Campbell ..... A41D 13/04 2/51
2016/0219944 A1 * 8/2016 Berns ..... A41D 13/0015
2016/0338436 A1 * 11/2016 Horrey ..... A41F 17/00
2017/0238622 A1 * 8/2017 Christopher ..... A41C 1/003

OTHER PUBLICATIONS

Cramer Hamstring Compression Shorts for Thigh & Groin Support. Printed Oct. 5, 2017. https://www.amazon.com/Hamstring-Compression-Shorts-Thigh-Support-White-L/dp/B00ID7FX04.

McDavid Cross Compression Shorts with Hip Spica. Printed Oct. 5, 2017. http://www.mcdavidusa.com/cross-compressiontm-short-w-hip-spica.

* cited by examiner

GIRD COMPRESSION HIP TENSIONING GARMENT

BACKGROUND OF THE INVENTION

The present invention generally relates to a compression garment that, through its unique combination of elements, is adapted to provide gird compressive support for easing pain in a wearer's hip muscles, ligaments, and femoral joint area.

Chronic hip pain is increasingly common among Americans, with more than 1 in 14 having experienced such pain on a regular basis. There are many causes of such hip pain, including muscle and tendon strains, osteoarthritis, tendonitis, surgery, or sports-related injuries. In addition, hip pain may be related to ailments affecting the lower back. For instance, a herniated disc in the lumbar region may be the source of not just lower back pain, but also of stress or pain in the hip region. A similar effect of hip pain may be observed in those suffering from sciatica.

This interrelated experience of pain is at least partially attributable to the anatomical connectivity between the hip and lower back. The hip consists of more than a dozen individual muscles that have been categorized into four groups: the iliopsas group, the adductor group, the lateral rotator group, and the gluteal group. Although these muscles are generally associated with the pelvic region of the body, several muscles extend into the lower lumbar region of the spine. The lumbar region of the spine consists of five vertebrae (numbered L1 through L5), which extend generally from the base of the rib cage to the upper portion of the buttocks. Below the lumbar region is the sacrum, which consists of five fused vertebrae (numbered S1 through S5), that help connect the spine to the hip by forming part of the pelvic girdle. Below the sacrum at the base of the pelvic girdle is the lowest portion of the spine, called the coccyx, which is also colloquially known as the tailbone.

There are a variety of devices available to treat chronic hip pain, but they have proven incapable of relieving such mid-body pain and joint stress in many users. For instance, compression shorts with varying designs and made of various materials are widely available. However, these shorts may be ineffective at treating hip pain and associated lower back pain in users for several reasons. First, they are not adjustable; while often composed of elasticized fabric, these shorts are not able to be tightened or loosened so as to provide variable compressive tensioning. Second, prior art compression shorts are not generally designed to provide compressively linked support between the hips and the lower back region, which means that they generally are incapable of treating ailments that, for instance, were caused by a interrelated trauma or minor damage to the hips and lower lumbar region. Moreover, those shorts are inconvenient for many users, because they generally do not permit undergarments to be comfortably worn at the same time as the shorts.

In addition, there are a number of commercially available compression wraps for providing targeting treatment to a specific muscle group or joint. While these wraps provide adjustability that is generally lacking in compression shorts, they do not provide the sort of continuous, simultaneous, girded support to the entire hip region, and thus may not properly maintain the alignment that can be so useful for recovering from surgery, promoting recovery from sport-related injuries, promoting healing and preventing injury recurrence, and for relieving chronic pain. Many individuals suffering from hip pain with interrelated stress on the lower lumbar regions would be likely to benefit from a garment that provides girded alignment and support to these two regions of the body.

In addition, a gird compression garment adapted to help alleviate pain in the wearer's upper body, including the cervical and thoracic regions of a wearer's body, has been disclosed by the inventor in co-pending U.S. patent application Ser. No. 15/370,619, entitled Gird Compression Garment with Cervical Collar, which is incorporated herein by reference. However, that garment is specifically constructed and adapted to treat portions of the wearer's body other than the hip region, and could not be used alone to treat hip pain in a wearer.

Thus, there is no existing compression garment that provides combinatorial and continuous girded compressive support that encircles the wearer's acetabulofemoral and lower torso regions, to aid in recovery from surgery or a non-surgical injury or condition in the hips, and to relieve joint and muscle pain in those regions of a wearer's body. Accordingly, there is a need for a resiliently flexible compression garment adapted to provide girded support and treatment for the hip regions of the body.

BRIEF SUMMARY OF THE INVENTION

The present invention comprises a resiliently flexible compression garment adapted to encircle the acetabulofemoral, gluteal, and upper pelvic regions of the wearer's lower torso, that further comprises a vertically oriented ligature panel and a fastening placket. The compression garment of the present invention is adapted so that its uppermost rear portion can be preferably placed at approximately the base of the lumbar portion of the spine. The present invention is further directed to a gird compression garment made of bi-directional stretchable fabric that is adapted to encircle a portion of a wearer's body that includes the hip area. The bi-directionality of this material is advantageous because it allows for it to be oriented so as to provide effective, girded support that holds the wearer's acetabulofemoral and gluteal regions in compressive alignment.

Preferably, the present invention comprises a plurality of resiliently flexible panels adapted to conform to the body of a wearer and encircling the gluteal and acetabulofemoral regions; a resiliently flexible vertically oriented ligature panel; and a fastening placket adapted to adjust the compressive force exerted by the garment on the wearer. More preferably, each set of resiliently flexible panels is further coupled to a resiliently flexible anchoring garter, which is adapted to hold the entire garment in place and prevent unwanted movement. The resiliently flexible anchoring garters are preferably adapted to encircle approximately the midpoint of the wearer's quadriceps, or more preferably at a point approximately seven inches below the greater trochanter of a wearer.

The object of the present invention is to provide relief from certain chronic mid-body pain that is not fully treatable using prior art compression garments or other known treatment devices. By providing resiliently flexible, girded compression that is not limited to isolated portions of the mid-body region, but rather that extends throughout the gluteal and acetabulofemoral regions, the embodiments of the present invention are adapted to provide remedial support for treatment of hip injuries and alleviation of pain in certain users. Furthermore, the embodiments of the present invention are adapted to provide for better posture and joint coordination (particularly by promoting better right-to-left hip alignment), more stable movements, and more complete muscle relaxation for performance of daily activities, in addition to being adapted to protect against recurrence of injury related to more strenuous activities, including sports and other athletic endeavors. This is accomplished in part through the simulation of and encircling support for the iliopsas muscle.

The embodiments of the present invention are believed to be useful for the treatment of a variety of ailments, including dislocated hip joints, torn cartilage, torn or strained muscles, torn or strained ligaments, joint tendinitis, joint arthritis, or herniated discs in the lower back, and in the prevention of injury recurrence (such as in wearers with healed pelvic fractures). Furthermore, the embodiments of the present invention may be used to reduce and/or minimize pain in the acetabulofemoral joint, the lower lumbar vertebrae, the sacral vertebrae, and the coccyx, in part by promoting proper hip posture that synchronizes with the lower lumbar region. In addition, the embodiments of the present invention may be particularly effective for treatment during the remodeling phase of muscle or joint recovery, i.e., after the injury phase, the acute/inflammatory phase, and the repair/regeneration phase have been completed. In this way, the embodiments of the present invention may aid in the rehabilitation of injuries and promote comfort for a wearer. In addition, this garment may be useful for active users without injuries in order to decrease the chances of injuring or over-stretching muscles and ligaments during daily physical activities.

DETAILED DESCRIPTION OF THE INVENTION

Figure 1:
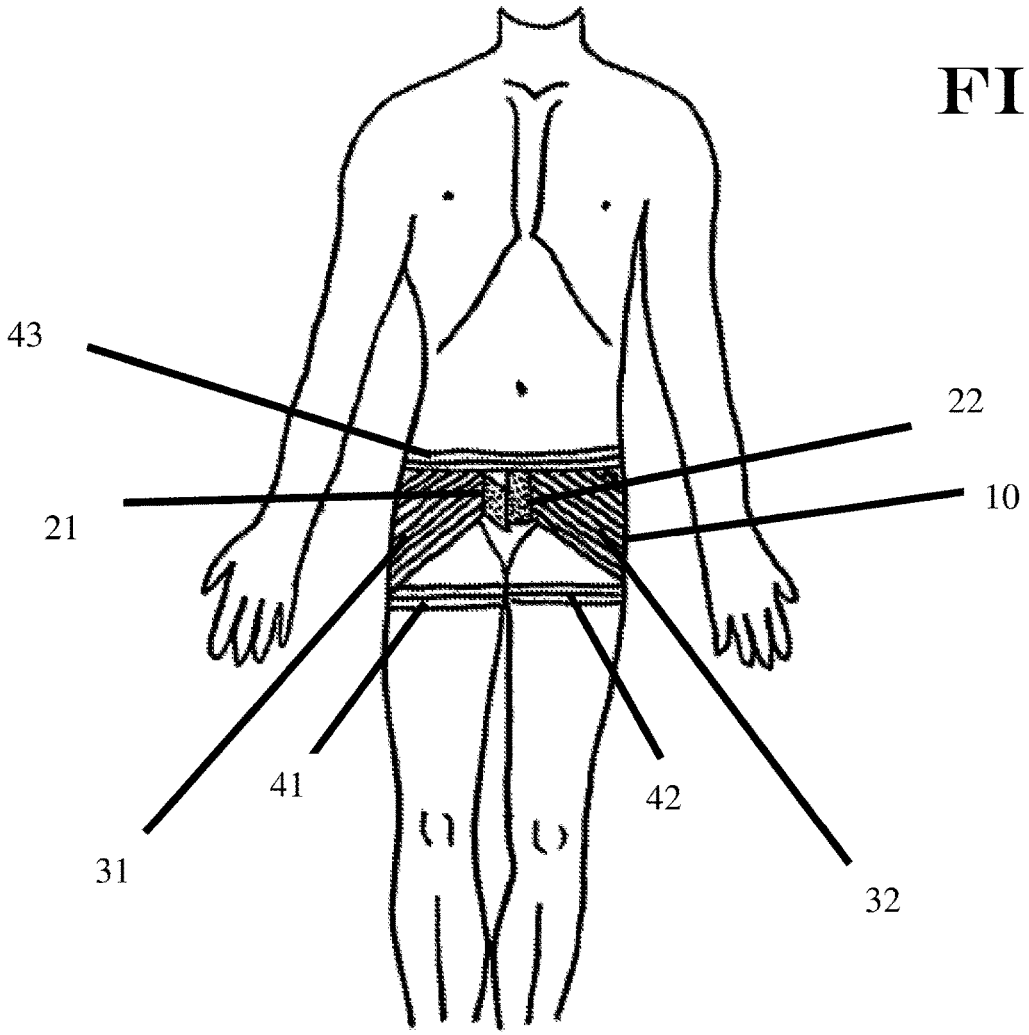
FIG. 1 is a front perspective of a gird compression hip tensioning garment according to the present invention.

FIG. 1 illustrates the front view of an exemplary embodiment of a gird compression hip tensioning garment in accordance with the present invention. The depicted garment can be adapted to be worn by both men and women of various sizes. The garment 10 of FIG. 1 comprises a front right-side panel 31, which is adapted to conform to the right-hand side of a wearer's acetabulofemoral and hip regions, and a front left-side panel 32, which is adapted to conform to the left-hand side of a wearer's acetabulofemoral region and lower torso. The garment 10 also preferably comprises a waistband 43.

The garment 10 of FIG. 1 further comprises a fastening placket 21. Preferably, the fastening placket 21 is adapted to extend from one edge of the wearer's lower abdominal wall to the other edge, as shown in FIG. 1. Preferably, the fastening placket 21 is at least approximately 4 inches in length, and at least approximately 4 inches in width. The fastening placket 21 of this embodiment is further adapted to allow for the adjustment of the compressive force exerted by the garment 10 on the body of the wearer. The fastening placket 21 preferably includes a fastening strip that can be attached to one or more complementary fastening strips 22 located on a panel 31 or 32 of the garment 10. Those complementary fastening strips 22 may be integrally sewn into the panel 31 or 32. Preferably, the complementary fastening strip 22 is adapted to extend approximately the entire length of the fastening placket 21 to ensure a strong, complementary connection. More preferably, the fastening placket 21 and complementary fastening strips 22 comprise VELCRO® brand hook-and-loop or touch fasteners.

In a preferred embodiment, the fastening placket 21 is sewn into the garment 10, such that the lining or backing of the fastening placket 21 is exposed on the front portion of the garment 10. More preferably, the fastening placket 21 is sewn into the right-side front panel 31, such that the backing or liner of the fastening placket 21 is covered by the same resiliently flexible material as the panels 31 and 32.

The garment 10, including the front panels 31 and 32, is preferably made from a resiliently flexible material that is bi-directionally stretchable. More preferably, the plurality of panels of the garment 10 are made from the same resiliently flexible, bi-directionally stretchable material. More preferably, the resiliently flexible material is more stretchable in a first direction than it is in a second, perpendicular direction. For instance, bi-directionally stretchable resiliently flexible materials that are well-suited to the present invention include spandex, polyester, or elastane that is approximately four times as stretchable in a first direction than it is a second, perpendicular direction.

Preferably, the bi-directionally stretchable resiliently flexible material of front panels 31 and 32 is oriented so that the more stretchable axis of the material is diagonal with respect to the median or sagittal plane of the wearer's body. This orientation is illustrated in FIG. 1 by the parallel, striated lines that form an angle with respect to the median plane (which is parallel to the edges of the fastening placket 21). This diagonal orientation is believed to provide for superior compressive support as compared to prior art garments because it lifts and secures the acetabulofemoral musculature so as to better align and support the sacral vertebrae and associated musculature. The waistband 43 of garment 10 is also preferably made of the same bi-directionally stretchable resiliently flexible material, preferably oriented as shown in FIG. 1.

Figure 2:
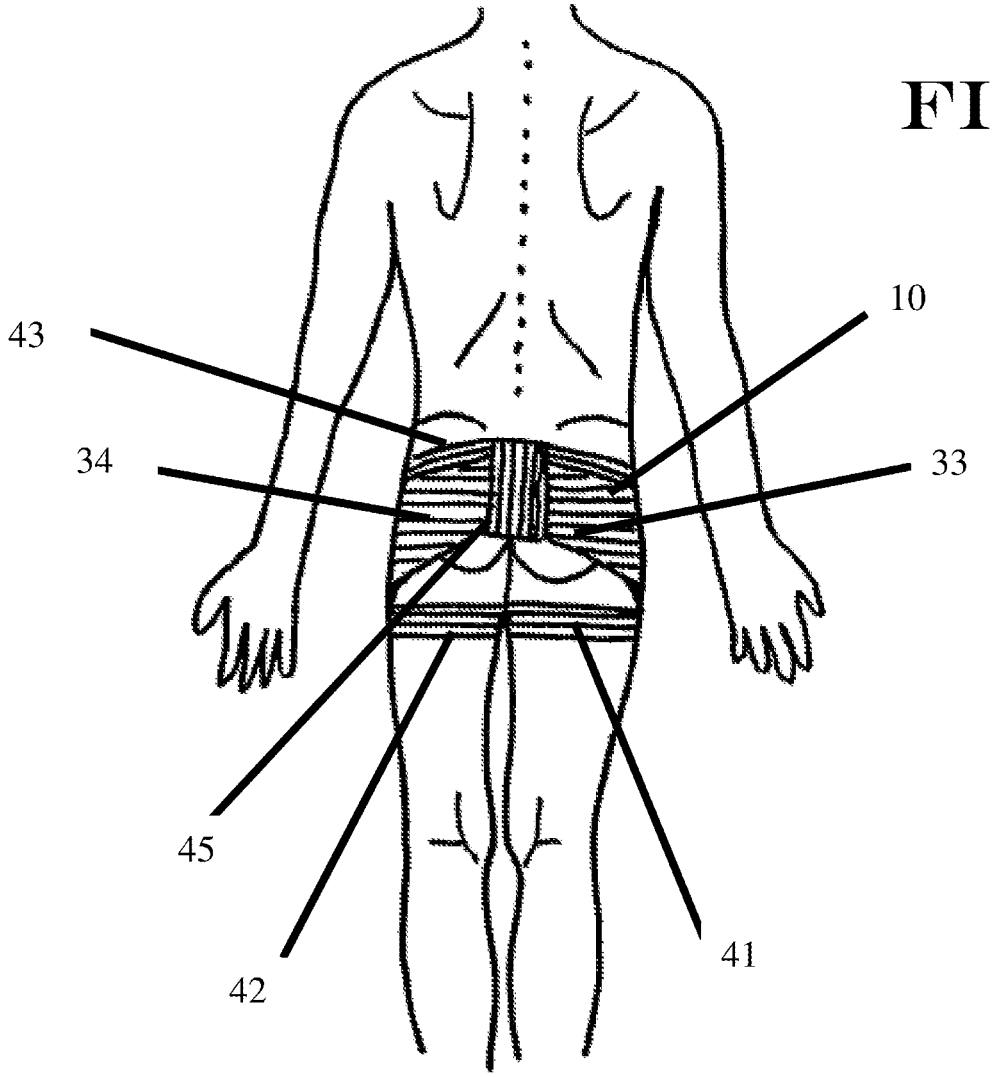
FIG. 2 is a rear perspective of a gird compression hip tensioning garment according to the present invention.

FIG. 2 illustrates the rear view of an exemplary embodiment of a gird compression hip tensioning garment 10 according to the present invention for both male and female users. The garment 10 of FIG. 2 comprises a rear right-side panel 33, which is adapted to conform to the right-hand side of a wearer's acetabulofemoral and gluteal regions, and a rear left-side panel 34, which is adapted to conform to the left-hand side of a wearer's acetabulofemoral and gluteal regions.

Preferably, the rear panels 33, 34 are made from the same bi-directionally stretchable material as front panels 31, 32. Preferably, the bi-directionally stretchable resiliently flexible material of rear panels 33 and 34 is oriented so that the more stretchable axis of the material is oriented parallel to the transverse or axial plane of the wearer's body. This orientation is illustrated in FIG. 2 by the parallel, striated lines that are perpendicular to the median plane of the body. This combination of this orientation for rear panels 33, 34 with the different orientation for panels 31, 32 (as described above) is believed to provide for superior compressive support as compared to prior art garments because it takes advantage of the natural curvature of the gluteal muscles to promote hip stability.

Figure 4:
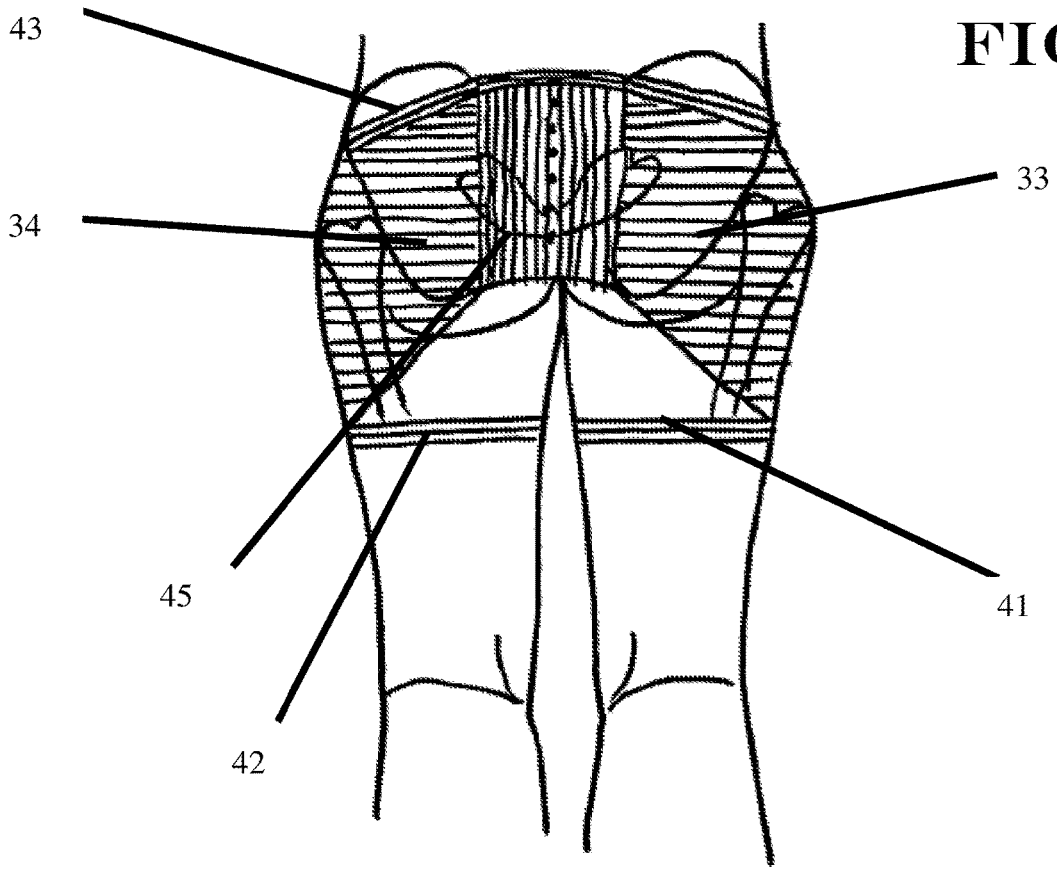
FIG. 4 is a rear perspective of a gird compression hip tensioning garment according to the present invention, with the internal skeletal structure of a typical wearer visible to show the preferred positioning of the garment on a wearer.

The garment 10 of FIG. 2 includes a ligature panel 45. Preferably, the right and left rear panels 33 and 34, respectively, are sewn into opposite sides of the ligature panel 45. More preferably, the ligature panel 45 is rectangular, as shown in FIG. 2. The ligature panel 45 can preferably extend from approximately the sacrum of the spine to the mid-gluteal region below the tailbone or coccyx (i.e., where the gluteus medius muscles are located), as illustrated in FIG. 4. The ligature panel 45 is preferably made from the same bi-directionally stretchable resiliently flexible material as the other portions of the garment 10, e.g., spandex or elastane. The resiliently flexible material that comprises the ligature panel 45 is preferably oriented so that the more stretchable axis of the material is oriented parallel to the median or sagittal plane of the wearer's body, and along the spinal column of the wearer. This orientation is shown by the vertical striated lines depicted in the interior of the ligature panel 45 in FIG. 2. It is believed that this particular orientation and the fact that the ligature panel 45 is adapted to help secure and anchor the acetabulofemoral joints, gluteal musculature, and associated joints, can allow for better relief of pain in the hip and lower lumbar regions of a wearer through continuous support.

Figure 3:
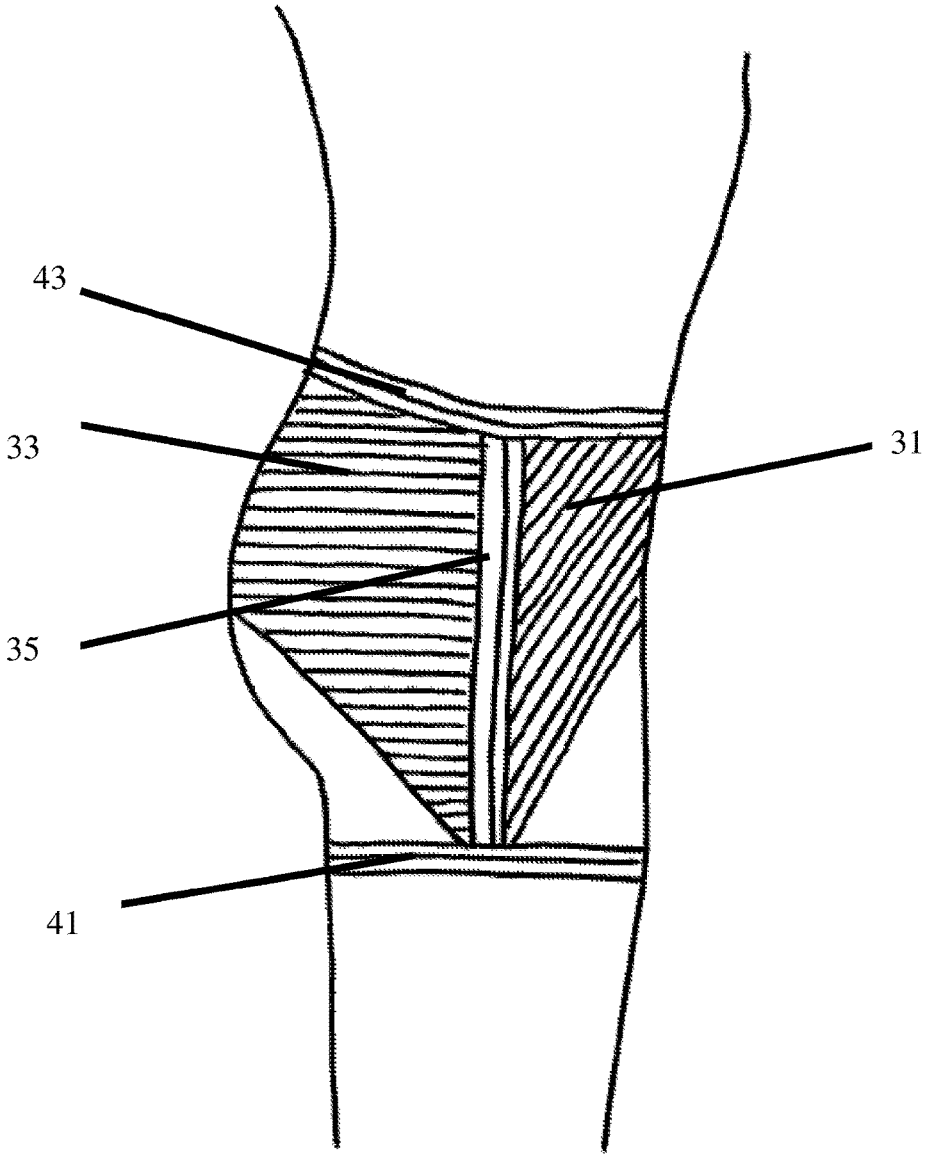
FIG. 3 is a side perspective of a gird compression hip tensioning garment according to the present invention.

Preferably, as illustrated in FIG. 3, the front right-side panel 31 is coupled to rear right-side panel 33 through a sewn attachment band 35. Although not shown, the same sort of sewn attachment band is preferably used to couple the front left-side panel 32 to the rear left-side panel 34. This sewn attachment band 35 is preferably made of the same bi-directionally stretchable resiliently flexible material of the plurality of panels 31, 32, 33, and 34, and is preferably oriented in the vertical direction, as illustrated by the vertical striated lines shown in FIG. 3.

The garment 10 of FIGS. 1 & 2 further comprises a right-side resiliently flexible anchoring garter 41, which is adapted to conform to the right quadriceps of a wearer, and a left-side resiliently flexible anchoring garter 42, which is adapted to conform to the left quadriceps of a wearer. The right-side anchoring garter 41 is coupled to right-side panels 31 and 33, while the left-side anchoring garter 42 is coupled to the left-side panels 32 and 34. Preferably, the resiliently flexible anchoring garters 41 and 42 hold the garment 10 in place, and prevent unwanted upward drift of the garment 10 that would otherwise be caused by normal movement such as walking or sitting. More preferably, the resiliently flexible anchoring garters 41 and 42 are adapted to encircle approximately the midpoint of the wearer's quadriceps, or more preferably at a point approximately seven inches below the wearer's greater trochanter.

Although the preferred embodiment of the invention has been described in detail for purposes of illustration, various modifications may be made without departing from the scope and spirit of the invention.

The invention claimed is:

1. A gird compression hip tensioning garment, comprising:

a plurality of resiliently flexible panels adapted to conform to the musculature of a wearer that is located in the acetabulofemoral region and mid-gluteal region of a wearer's body, wherein said plurality of resiliently flexible panels are made of a bi-directionally stretchable material that is more stretchable in a first direction than it is in a second, perpendicular direction;

and wherein said plurality of resiliently flexible panels further comprises a plurality of rear-side panels comprising a right-side rear panel adapted to compressively gird a right-hand rear side of the wearer's body and a left-side rear panel adapted to compressively gird a left-hand rear side of the wearer's body, wherein said plurality of rear-side panels are adapted so that the more stretchable axis of said bi-directionally stretchable material is oriented parallel to a transverse plane of the wearer's body, and wherein said plurality of resiliently flexible panels further comprise a plurality of front-side panels comprising a right-side front panel adapted to compressively gird a right-hand front side of the wearer's body and a left-side front panel adapted to compressively gird a left-hand front side of the wearer's body, wherein said plurality of front-side panels are arranged so that the more stretchable axis of said bi-directionally stretchable material is oriented diagonally as compared to the more stretchable axis of the bi-directionally stretchable material of said plurality of rear-side panels;

a resiliently flexible ligature panel located between the plurality of rear-side panels, said resiliently flexible ligature panel being rectangular and adapted to support the lower portion of the spine of the wearer, wherein said resiliently flexible ligature panel is arranged so that the more stretchable axis of said bi-directionally stretchable material is oriented perpendicular to the more stretchable axis of the bi-directionally stretchable material of said plurality of rear-side panels;

and a fastening placket adapted to adjust the compressive force exerted by said garment on the wearer.

2. The gird compression hip tensioning garment of claim 1, wherein said plurality of resiliently flexible panels and said resiliently flexible ligature panel are made of spandex.

3. The gird compression hip tensioning garment of claim 2, wherein said right-side front panel is coupled to the right-side rear panel and the left-side front panel is coupled to said left-side rear panel through a sewn seam.

4. The gird compression hip tensioning garment of claim 1, wherein said resiliently flexible ligature panel is adapted to extend from a base of a lumbar spine to a mid-gluteal region of the wearer.

5. The gird compression hip tensioning garment of claim 1, wherein said garment further comprises a plurality of resiliently flexible anchoring garters adapted to gird quadriceps of the wearer.

6. The gird compression hip tensioning garment of claim 1, wherein at least one of said resiliently flexible panels comprises a fastening strip that is complementary to said fastening placket.

7. The gird compression hip tensioning garment of claim 1, wherein said garment further comprises a waistband.

* * * * *